US007228660B2

(12) United States Patent
Rhode et al.

(10) Patent No.: US 7,228,660 B2
(45) Date of Patent: Jun. 12, 2007

(54) WINDOW JAMB ASSEMBLY

(76) Inventors: Joel T. Rhode, 1647 Middleton Ave., St. Paul, MN (US) 55116; James L. Peterson, 2850 Jordan Dr., Woodbury, MN (US) 55125; William D. Gribble, 2211 Spring Side Dr., St. Paul, MN (US) 55119

( * ) Notice: Subject to any disclaimer, the term of this patent is extended or adjusted under 35 U.S.C. 154(b) by 474 days.

(21) Appl. No.: 10/678,623

(22) Filed: Oct. 3, 2003

(65) Prior Publication Data

US 2004/0139668 A1 Jul. 22, 2004

Related U.S. Application Data

(60) Provisional application No. 60/440,762, filed on Jan. 17, 2003.

(51) Int. Cl.
*E05D 15/18* (2006.01)

(52) U.S. Cl. ..... 49/428; 49/415; 49/454

(58) Field of Classification Search ..... 49/428, 49/414, 415, 416, 431, 432, 434, 429
See application file for complete search history.

(56) References Cited

U.S. PATENT DOCUMENTS 5,265,308 A 11/1993 May et al.
5,566,507 A 10/1996 Schmidt et al.
5,772,190 A 6/1998 May et al.
6,305,126 B1 10/2001 Hendrickson et al.
6,684,571 B2 * 2/2004 Hendrickson et al. ..... 49/428
6,722,082 B1 * 4/2004 Peterson et al. ..... 49/428

* cited by examiner

*Primary Examiner*—Carl D. Friedman
*Assistant Examiner*—Chi Q. Nguyen
(74) *Attorney, Agent, or Firm*—Westman, Champlin & Kelly, P.A.; Z. Peter Sawicki

(57) ABSTRACT

The present invention includes a window jamb assembly mountable in a jamb of a double hung window for cooperative engagement with upper and lower sash assemblies. The window jamb assembly includes a jambliner that has inner and outer sash hardware accepting recesses and first and second weather-strip retaining recesses disposed between the sash hardware accepting recesses. First and second weather-strips are retained by the first and second weather-strip retaining recesses and cover strips are disposed in a remainder of the weather-strip recess that is not retaining a weather-strip. The cover strips have a facade portion that provides a visually pleasing finish.

18 Claims, 7 Drawing Sheets

WINDOW JAMB ASSEMBLY

CROSS-REFERENCE TO RELATED APPLICATION(S)

Applicant claims the priority date of U.S. Provisional Application 60/440,762, filed Jan. 17, 2003.

BACKGROUND OF THE INVENTION

The present invention relates to jamb assemblies for double hung windows, and in particular, to a jamb assembly that provides a weather-seal for a double hung window and a visually pleasing finish.

Jambliners are used to mount window sashes in a double hung window configuration so that the window sashes may be moved up and down to be placed either in an open or a closed position. The jambliners have recesses in which hardware is placed to permit the windows to be moved in an up and down fashion.

In addition to providing a means for moving window sashes up and down, the jambliners also strive to provide a weather-seal between the window sash and the jambliner when the windows are in a closed position. Recesses are also provided to retain the weather-strip. When the windows are in a closed position, it is also desired to provide a finished look to the window. One problem with jambliners is that they are an integrally extruded piece typically extruded of polyvinylchloride (PVC) or other plastic which results in recesses running the length of the jambliner and being open to view when the windows are in a closed position. The portion of the recesses that are open to view are not associated with (hidden by) a window sash and are therefore open to view. The Hendrickson et al. U.S. Pat. No. 6,305,126 provides one solution to covering up those portions of the recesses that do not retain weather-stripping. The solution is another recess disposed between the recesses that retain the weather-stripping. This central or middle recess is used to insert a cover strip which then extends on an exterior surface of the jambliner to provide a visually pleasing finish.

BRIEF SUMMARY OF THE INVENTION

The present invention includes a window jamb assembly mountable in a jamb of a double hung window for cooperative engagement with upper and lower sash assemblies. The window jamb assembly includes a jambliner that has inner and outer sash hardware accepting recesses and first and second weather-strip retaining recesses disposed between the sash hardware accepting recesses. First and second weather-strips are retained by the first and second weather-strip retaining recesses and jambliner cover strips are disposed in a remainder of the weather-strip recesses that do not retain a weather-strip. The jambliner cover strips have a facade portion that provides a visually pleasing finish.

In addition, the present invention includes a weather-strip that provides a weather seal between two surfaces, one of the surfaces including a channel for retaining the weather-strip. The weather-strip includes a weather sealing portion having a forward edge for engaging the movable surface and a first leg for engaging one edge of the channel and a second leg for engaging another edge of the channel and a spring arm cooperating with at least one of the legs and having a distal free end for engaging a backwall of the channel. The spring arm exhibits a spring force to move the sealing portion to a weather sealing position with the movable surface. Since the weather-strip is not attached to the surface of the channel, it is free floating with respect to that surface.

DETAILED DESCRIPTION

Figure 1:
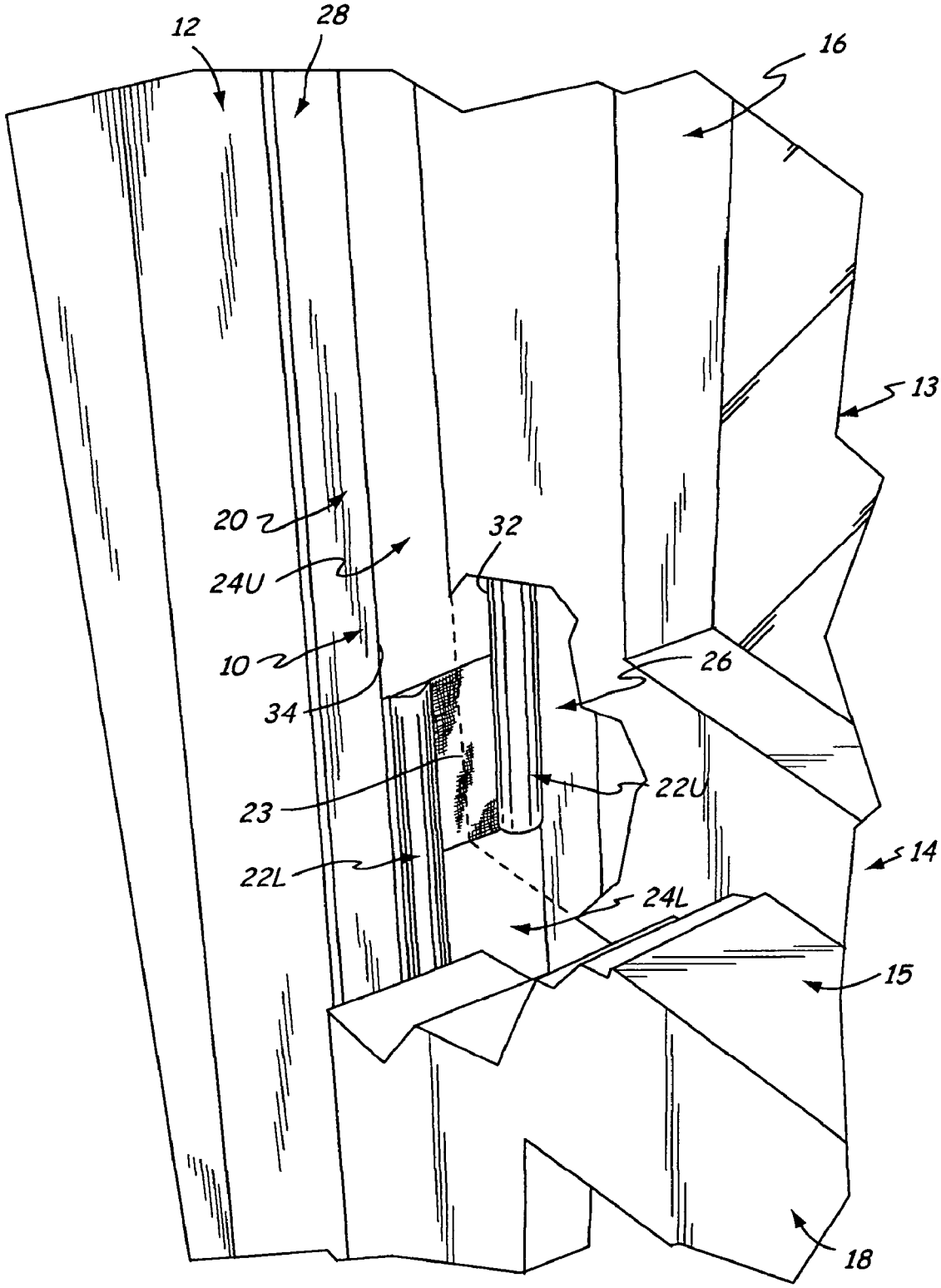
FIG. 1 is a perspective view of the jambliner assembly of the present invention.

The present invention includes a window jamb assembly generally indicated at 10 in FIG. 1. The window jamb assembly is mountable in a jamb 12 of a double hung window 14. The double hung window 14 has an upper portion 13 with an upper sash 16 and a lower portion 15 with a lower sash 18. The upper and lower sashes 16, 18 cooperate with the jamb assembly 10. The jamb assembly 10 has a length and width selected to correspond to the window jamb 12 with which it is used.

The jamb assembly 10 includes a jambliner 20, weather-strips 22U and 22L and jambliner covers 24U and 24L. The jambliner 20 is extruded typically of a plastic such as polyvinylchloride (PVC) and includes sash assembly recesses 26 and 28 and two weather-strip recesses 32 and 34 disposed between the sash assembly recesses 26 and 28 for retaining the weather-strips 22U and 22L and the jambliner covers 24U and 24L. The sash assembly recesses 26 and 28 and the weather-strip recesses 32 and 34 run the length of the jambliner.

The jambliner covers 24U and 24L engage the weather-strip recesses 32 and 34 in portions that are not occupied by the weather-strips 22U and 22L to provide aesthetically pleasing coverings over such portions of the recesses and adjacent areas of the jambliner. The cover strip 24U and the weather-strip 22U are associated with the upper portion 13 of the window while the cover 24L and the weather-strip 22L are associated with the lower portion 15 of the window 14. Utilizing the construction of the present invention, the cover 24U covers that portion of the weather-strip recess 34 that is in the upper portion of the window 14 and which is not occupied by the weather-strip 22L which occupies the recess 34 that is in the lower portion 15 of the window 14. Similarly the cover portion 24L covers that portion of the weather-strip recess 32 in the lower portion 15 of the window 14 that is not occupied by the weather-strip 22U which lies in the upper portion 13 of the window 14.

It will be appreciated that the weather-strips 22U and 22L are of a length that is at least substantially equal to the length of the sash assembly with which such weather-strip is associated. Similarly, the covers 24U and 24L are of a length that is sufficient to cover the remaining portions of the weather-strip recesses that are not occupied by the weather-strips 22U and 22L. Alternatively, the weather-strips 22U and 22L may extend the entire length of the weather-strip recess.

As specifically illustrated in FIG. 1, the weather-strips 22U and 22L are slightly longer than the respective sash assemblies with which such weather-strips are providing a weather seal. In the area that the weather-strips project beyond the respective sash assemblies, a weather seal 23 is affixed to the jambliner 20 to provide a weather seal between a lower portion of the upper sash assembly and an upper portion of the lower sash assembly when the double hung window is in a closed configuration. Alternatively, the weather-strips 22U and 22L may be less than the length of the sash with the weather seal extending between sash assembly recesses 26 and 28 and each weather-strip abutting against the weather seal. Such weather seals and the materials used are well known in the art.

The weather-strips 22U and 22L are typically the same in construction but could be different. For placement in either the upper portion 13 of the window 14 or the lower portion 15 of the window 14, the weather-strips are turned 180°.Similarly the covers 24U and 24L are of the same construction and may be turned 180° to fit either in the upper portion 13 of the window 14 or the lower portion 15 of the window 14. The weather-strip recesses interchangeably retain both the weather-strips 22U and 22L and the covers 24U and 24L to provide a flexible arrangement for sealing windows and jambliner covers over the unused portions of the weather-strip recesses. Such is accomplished using only the two weather-strip recesses disposed between the sash assembly recesses.

In reference to the embodiments described below, since the weather-strips and the jambliner covers are constructed the same, no distinction will be made as to whether weather-strips are upper or lower weather-strips or whether jambliner covers are upper or lower covers for purposes of ease of reference and only one reference character will be used for each of the weather-strips and each of the covers when referring to FIGS. 2 through 5.

Figure 2:
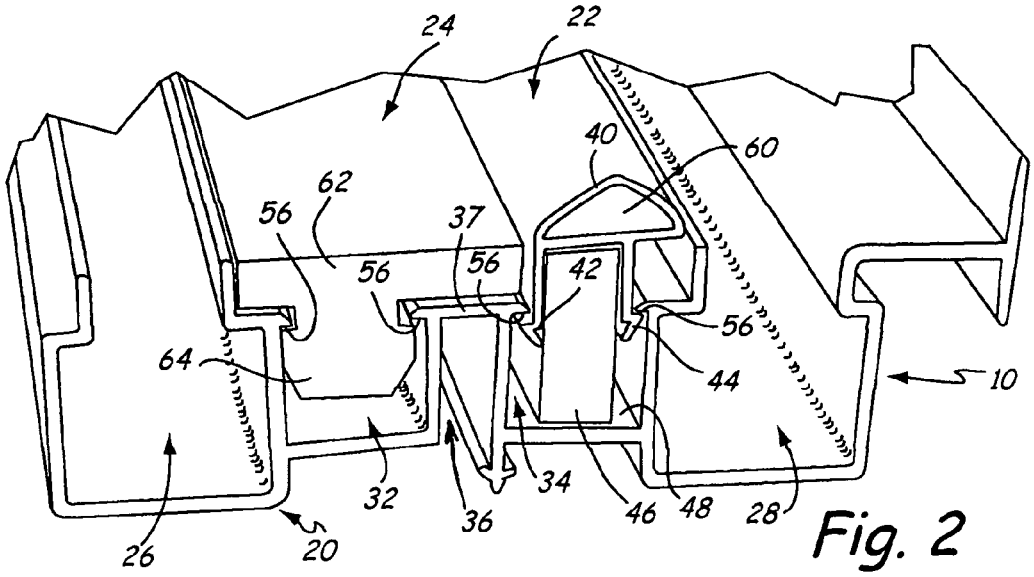
FIG. 2 is a perspective sectional view of one embodiment of the jambliner of the present invention.
Figure 3:
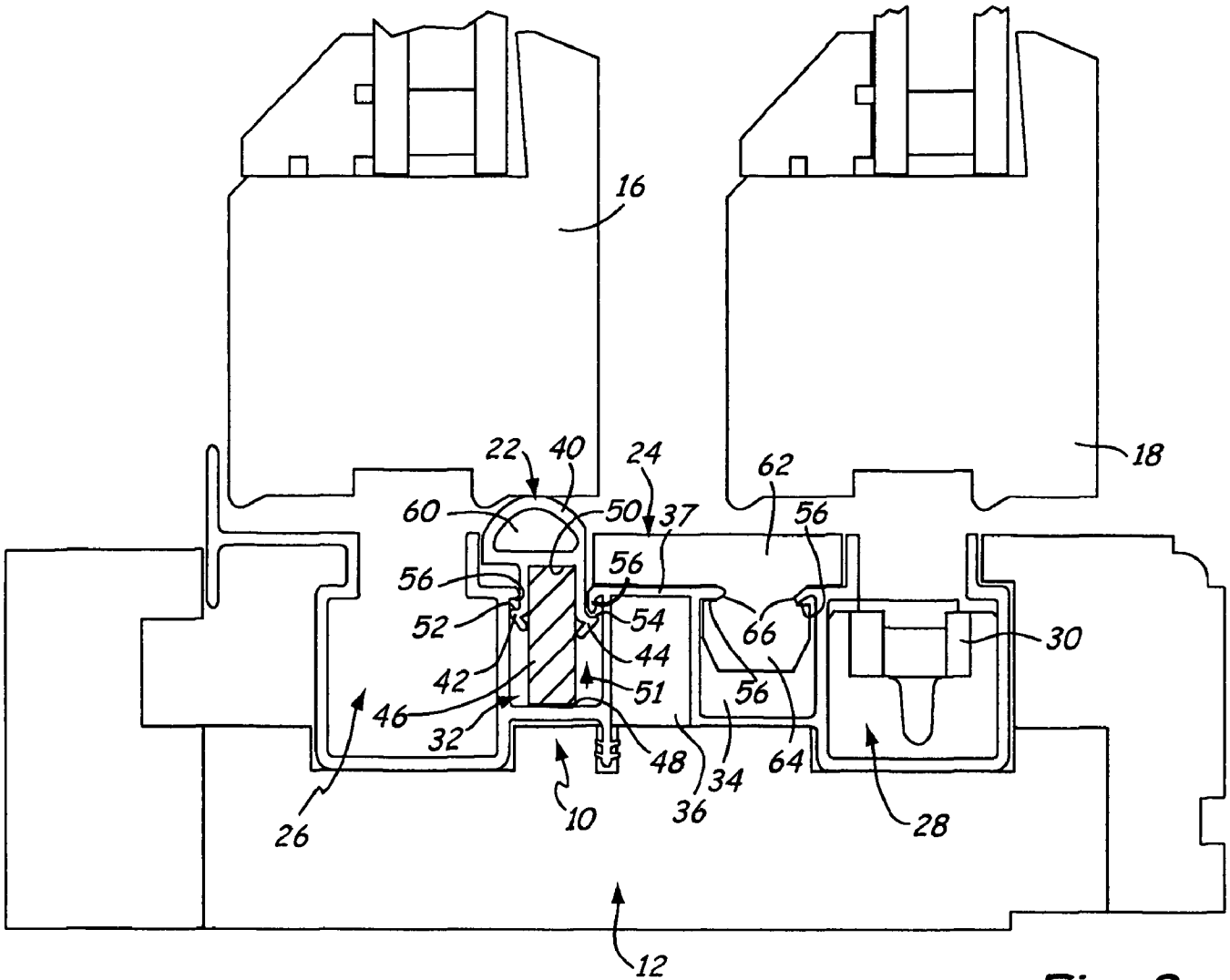
FIG. 3 is a sectional view of the embodiment of FIG. 2.

A first embodiment of the jamb assembly 10 is illustrated in FIGS. 2 and 3. The sash assembly recesses of the jambliner 20 accept sash assembly interfacing hardware 30 (only one of which is shown). The sash assembly interfacing hardware 30 facilitates retention and translation of the upper and lower sash assemblies 16 and 18 relative to the window jamb 12. The particular type of hardware used is unimportant to the present invention and is well known in the art.

The jambliner 20 further includes a chamber 36 disposed between the weather-strip recesses 32 and 34 that has an opening facing the window jamb 12 and a front wall 37 that hides from view the existence of the chamber 36. The existence of the chamber 36 or its non-existence depends on the width of the jamb which the jambliner covers. It will be appreciated, for larger width jambs, the jambliner has to be wider, and the width of the chamber 36 is therefore increased.

The weather-strip 22 includes a sealing portion 40 and a pair of resilient legs 42 and 44 that extend into the weather-strip recess 32. A foam block 46 is of a size and shape that fits between the resilient legs 42 and 44 and extends from a backwall 48 of the recess 32 to engage a backside 50 of the sealing portion 40 thereby providing a spring force in the direction indicated by arrow 51. The spring force pushes the weather-strip 22 up against the window sash 16 to provide a weather seal. To retain the weather-strip within the recess 32, the resilient legs 42 and 44 have shoulders 52 and 54, that respectively engage shoulders 56 which are at a forward most position of the recess 32. It will be appreciated that the shoulders 52 and 54 engage the shoulders 56 thereby retaining the weather-strip 22 in place when the sealing portion 40 is not in engagement with the sash 16.

The resiliency of the legs 42 and 44 permits insertion of the legs into the recess 32. The foam block 46 may be made of any suitable polymeric material such as polyurethane that is formed by processes well known to produce a resilient non-rigid foam. The sealing portion 40 is constructed of an exterior layer of polymeric material such as polyvinylchloride. The portion 40 has an interior 60 that may be filled with a resilient foam, or may be left empty. The weather-strip is typically extruded as one integral piece.

The jambliner cover 24 has a cover portion 62 that extends from the weather-strip 22 to an adjacent sash assembly recess as best illustrated in FIG. 3. The cover portion 62 not only covers a portion of the weather-strip recess from view but also an area of the jambliner from the sash assembly recess up to an adjacent weather-strip. Essentially, the cover portion 62 is used to cover that portion of the recess 34 that is not engaging a weather-strip and those adjacent areas between the weather-strip and the sash assembly recess. A recess engaging plug 64 extends rearwardly from the cover portion 62 and preferably runs the length of the cover 24. The plug 64 is insertable within the weather-strip recess 34 to retain the cover 24 in place. The jambliner cover 24 when positioned on an exterior side of the window 4 is intended to match the exterior trim of the window 14. When the jambliner cover 24 is positioned on an interior side of the window 14, the cover 24 may be made to match the interior trim of the window. The cover portion 62 may be made of actual wood, steel, aluminum, vinyl or any other material typically used for window trim. When the cover is not made of actual wood, the jambliner cover 24 is typically extruded as a single integral piece.

The above description with respect to the weather-strip in the recess 32 and the cover portion in the recess 34 is to be understood that each recess 32 or 34 is constructed exactly the same and that the shoulders 56 of the recess 32 are made to engage also the shoulders 66 of the plug portion 64 to provide interchangeability. Similarly, the shoulders 56 of the recess 34 are made to engage the shoulders 52 and 54 of the resilient legs 42 and 44 of the weather-strip 22.

Figure 4:
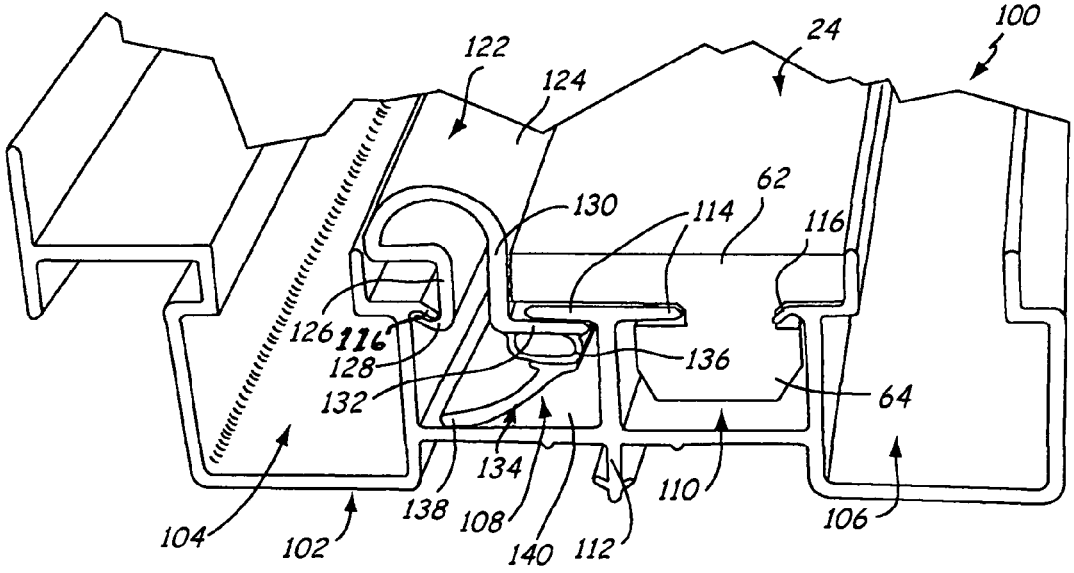
FIG. 4 is a perspective sectional view of another embodiment of the present invention.
Figure 5:
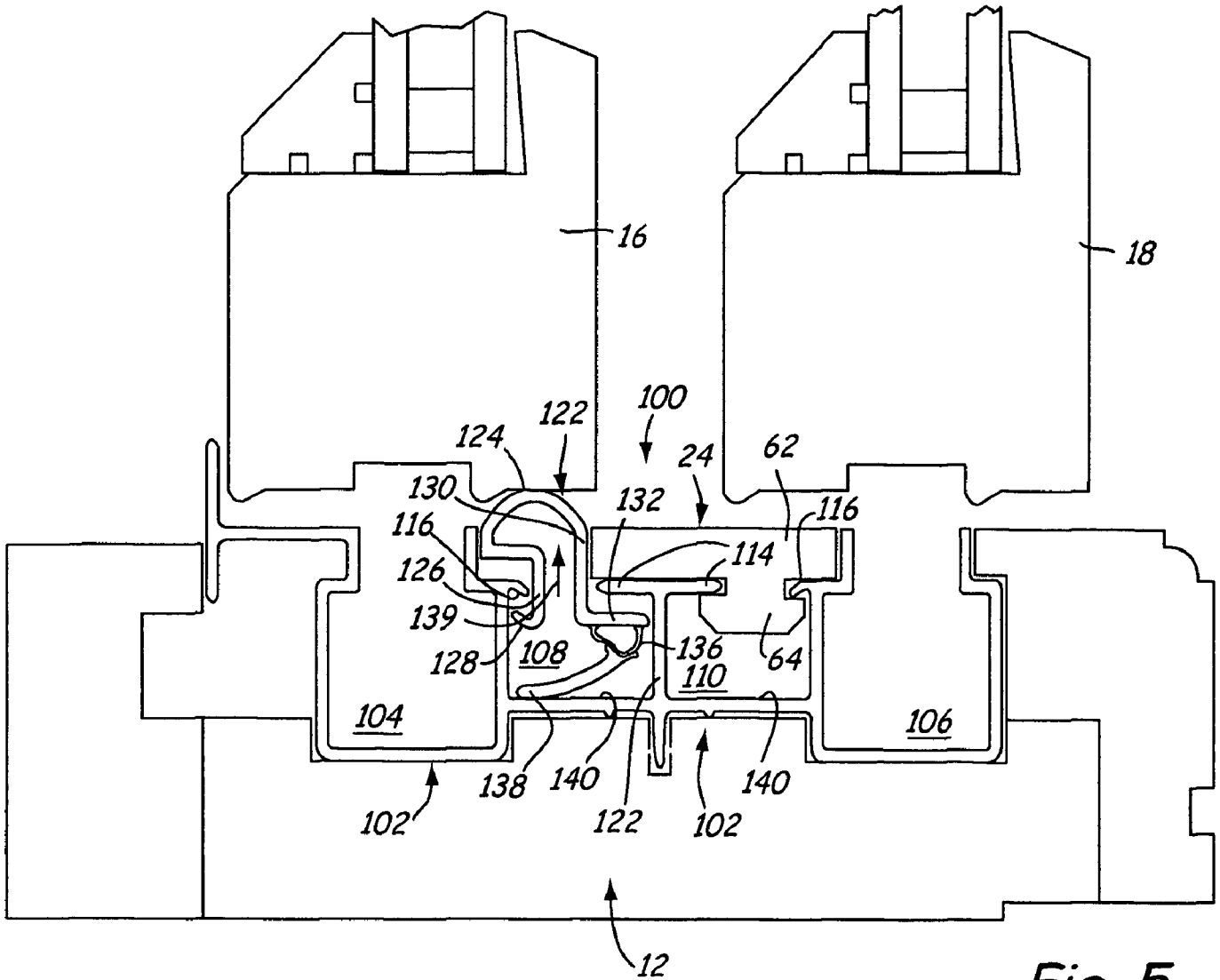
FIG. 5 is a sectional view of the embodiment of FIG. 4.

Another embodiment of the present invention is generally indicated at 100 in FIGS. 4 and 5. A jambliner 102 includes similarly constructed sash assembly recesses 104 and 106 and similarly constructed weather-strip recesses 108 and 110. The jambliner 102 does not include the chamber 36 as illustrated and described with respect to FIGS. 2 and 3. Instead, the weather-strip recesses 108 and 110 share a common wall 112. Each recess 108 and 110 includes shoulders 114 and slightly downwardly extending tabs 116. A cover 24 having a cover portion 62 and plug 64 is of the same construction as described with reference to the cover of FIGS. 2 and 3.

A weather-strip 122 having a sealing portion 124 is made of a polymer such as polyvinylchloride that when extruded in a layer having sufficient thickness has enough integrity to retain a rounded surface that engages the sash assembly while still being sufficiently resilient to form a weather seal with the sash assembly when pressed against it. The weather-strip 122 also has a first leg 126 having an end portion 128 with a hook-like configuration to engage one of the downwardly extending tabs 116. The weather-strip's other leg 130 has a end portion 132 projecting toward the common wall 112 and which engages the shoulder 114 of the jambliner 102.

On an opposite side of the leg portion 132 is attached a co-extruded plastic spring member 134. The plastic spring member 134 is described in U.S. Pat. Nos. 5,265,308 and 5,772,190, both being hereby incorporated by reference. The plastic spring member 134 is comprised of a semi-circular tubularly configured hinge 136 to which is attached a leg portion 138 that engages a backwall 140 of the recess 108 to provide a spring force, as indicated by arrow 139, in the direction of the sash assembly. The hinge 136 may be formed from any of a wide variety of resilient thermoplastic materials such as polyurethane or a polyester elastomer which resist creep while the leg portion is made of a relatively rigid plastic material such as PVC. The leg portions, the weather seal portions, the hinge and the weather-strip are typically co-extruded as one integral piece. Although a tubular hinge is shown, the hinge portion does not necessarily have to be tubular. The hinge may be co-extruded as a solid bead or other form attaching the leg portion 138 to the leg portion 132.

Figure 6:
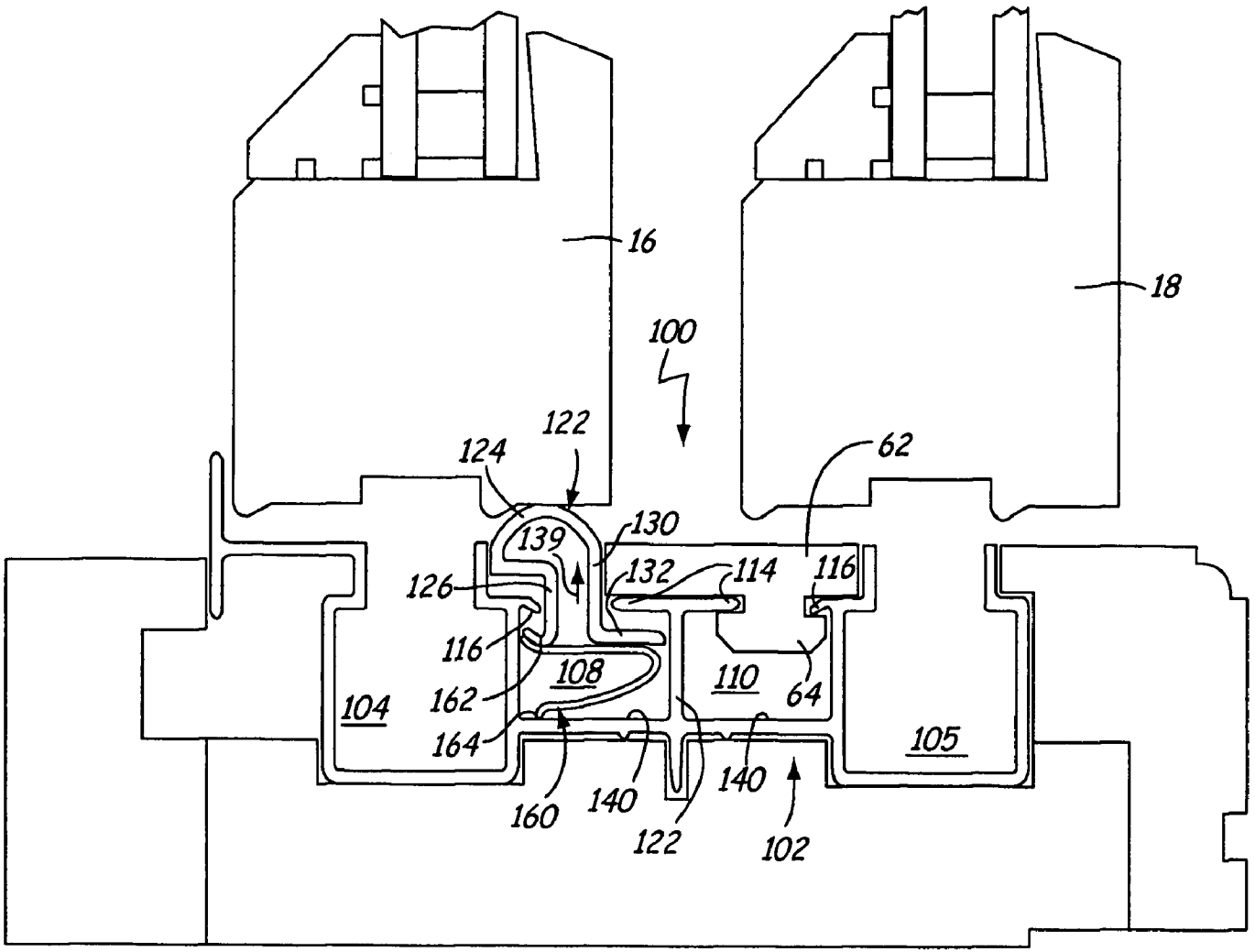
FIG. 6 is a sectional view of an alternative embodiment of the present invention.

The hinge may also be made of spring steel as indicated by reference character 160 in FIG. 6. The spring steel member 160 is attached to end portion 162 of the leg 126 of the weather-strip 122. Preferably, the spring steel member extends across recess 108 to leg portion 132. An opposite end 164 of the spring steel member 160 engages the backwall 140 of the recess 108 thereby providing a spring force in the general direction of arrow 139. Although a specific configuration of a spring is illustrated in FIG. 6, other spring configurations which provide the spring force 139 are included within the present invention.

The weather-strip 122 is a free floating weather-strip. By free floating is meant that the weather-strip is detachable from the jambliner and when the sash assembly applies a force against the weather-strip, the shoulders of the channel and the legs of the weather strip become separated.

Figure 7:
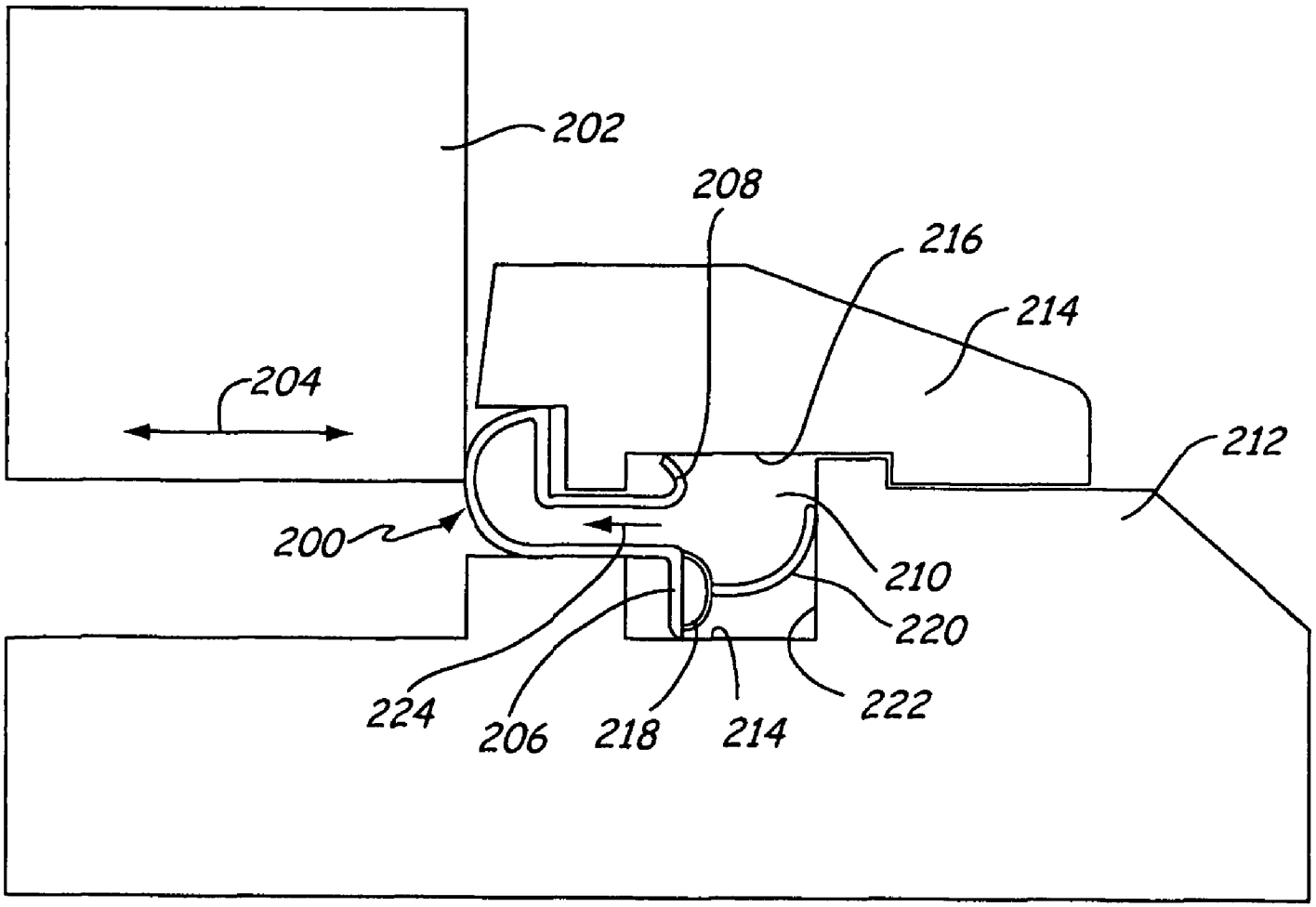
FIG. 7 is a sectional view of a free floating weather-strip of the present invention.

Alternatively, the weather-strip may also be used outside of a jamb assembly environment. As illustrated in FIG. 7, a weather-strip 200 of the present invention acts as a weather seal that is movable laterally in a direction indicated by arrow 204 as contrasted with the vertical movement of a double-hung window as described previously. The weather-strip 200 has leg portions 206 and 208 positioned within a recess 210 formed by window frame member 212 and molding 214. The molding 214 also acts as a stop for the sash 202. The leg portions 206 and 208 are positioned within the recess 210. The recess 210 is formed by recess 214 of the frame member 212 and recess 216 of the molding 214. The molding 214 is then attached to the frame member and with corresponding recess 216 forms the recess 210 that captures the legs 206 and 208 therein.

A tubularly configured hinge 218, as described with respect to FIG. 5, is attached to the leg portion 206. An arm portion 220 produced from a stiffer material is attached to the hinge at one end and engages a backwall 222 of the recess 210 thereby providing a spring force in a direction of arrow 224. The spring force places the weather-strip 200 against a surface of the sash 202 to create a weather-seal.

As is apparent from the above description, the free floating weather-strip 122 may be used in a variety of different environments. For example, it may be used as a weather seal for casement windows, that is windows that pivot about a hinge from an open to a closed position. The weather-strip 122 may also be used as a weather-strip for a door, either a pivoting type door or a sliding door. Other examples of the free floating weather-strip of the present invention are indicated at 200 in FIG. 8*a* and 202 in FIG. 8*b*. Both embodiments of FIGS. 8*a* and 8*b* may be used in a variety of environments as discussed previously above to form a weather seal between two surfaces, one of which is moved to an open position.

Figure 8A:
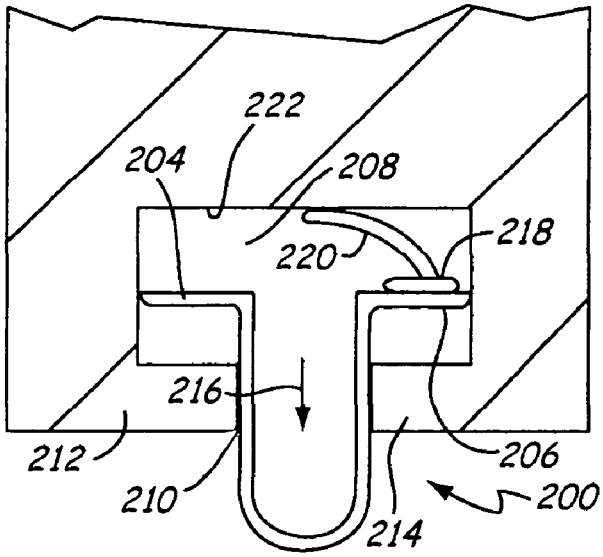
FIG. 8A is a sectional view of yet another alternative embodiment of the present invention.

Referring to FIG. 8*a*, the weather-strip 200 has leg portions 204 and 206 positioned within recess 208. The recess opening 210 is defined by shoulders 212 and 214 which retain the weather-strip within the recess by engaging the leg portions 204 and 206. Providing a spring force in the direction of arrow 216 is hinge 218 which is attached to one of the leg portions 206 and has arm section 220 attached at one end that extends rearwardly to engage the backwall 222 of the recess 208.

Figure 8B:
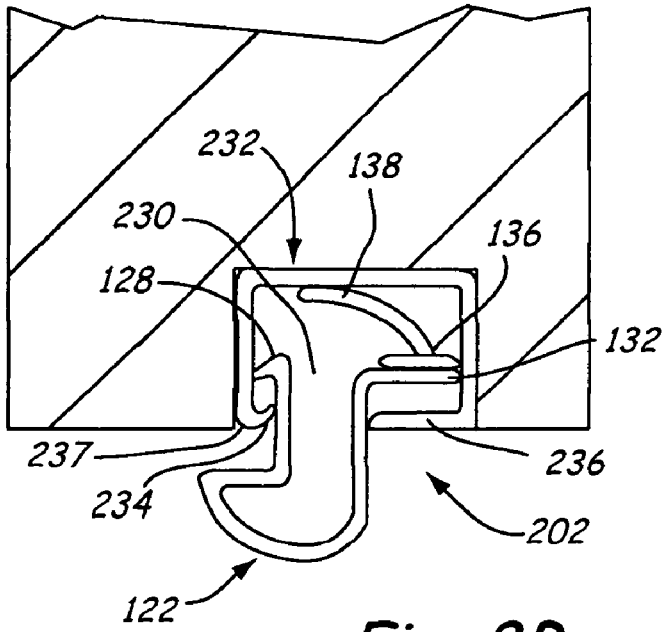
FIG. 8B is a sectional view of a further alternative embodiment of the present invention.

Similarly, the weather-strip 202 illustrated in FIG. 8*b* is the same as discussed with reference to FIG. 5, and like reference characters will be used to refer to like elements. The weather-strip 202 can also be used within a recess 230 that has no shoulders. A rail 232 having a slot 234 is inserted into the recess 230. The rail 232 has edge portions 236 and 237 that define a slot 234 and acts as stops to retain the weather-strip 122 within the recess 230. The weather-strip 122 is held within the recess by leg portions 128 and 132 engaging edge portions 236 and 237.

The rail 232 may be made of any type of material and is typically made of extruded polyvinylchloride. The rail may be glued or fixed into the recess by fasteners.

Although the present invention has been described with reference to preferred embodiments, workers skilled in the art will recognize that changes may be made in form and detail without departing from the spirit and scope of the invention.

The invention claimed is:

1. A window jamb assembly mountable in a jamb of a double hung window for cooperative engagement with upper and lower sash assemblies thereof, the window jamb assembly comprising:

a jambliner consisting of inner spaced apart sash hardware accepting recess and outer spaced apart sash hardware accepting recess extending longitudinally within the jambliner and first and second weather-strip retaining recesses extending longitudinally adjacent the first and second spaced apart sash hardware accepting recesses;

the inner and outer spaced apart sash hardware accepting recesses and the first and second weather-strip retaining recesses all being positioned on one side of the jambliner.

first and second weather-strips retained by the first and second weather-strip retaining recesses, the first and second weather-strips extending sufficiently to form a weather seal with respect to both upper and lower sashes, respectively; and jambliner cover strips retained by the first and second weather-strip recesses along a remainder of the weather-strip recess not retaining a weather-strip, the cover strips having a facade portion that extends between an adjacent weather-strip and a sash hardware accepting recess.

2. The jamb assembly of claim 1 wherein at least one of the cover strips further includes a recess engaging portion.

3. The jamb assembly of claim 1 wherein at least one of the weather-strips includes a weather sealing portion and a pair of resilient legs extending into either one of the weather-strip retaining recesses.

4. The jamb assembly of claim 3 and further including a spring element within the weather-strip retaining recess positioned between the resilient legs of the weather-strip and extending to a backwall of the weather-strip retaining recess.

5. The jamb assembly of claim 4 wherein the spring element is foam disposed between the resilient legs of the weather-strip.

6. The jamb assembly of claim 1 wherein at least one of the weather-strips includes a weather sealing portion and a spring arm attached at a proximal end to a backside of the weather-strip and the spring arm having a distal free end and exhibiting a spring force when the free end is engaged.

7. The jamb assembly of claim 1 and further including a spring element disposed within either of the weather-strip retaining recesses, the spring element being positioned on a rearward side of the weather-strip and extending to a backwall of the weather-strip retaining recess.

8. The jamb assembly of claim 7 wherein the spring element is foam that is disposed on the rearward side of the weather-strip and extending to the backwall of the weather-strip retaining recess.

9. The jamb assembly of claim 1 wherein at least one cover strip is made of wood, aluminum or polyvinylchloride.

10. A longitudinal jambliner assembly for use with upper and lower sash assemblies, the jambliner assembly comprising:

a jambliner consisting of a first elongated channel, a second elongated channel, a third elongated channel, and a fourth elongated channel, the elongated channels being sequentially spaced apart and substantially parallel with respect to each other and positioned on one side of the jambliner; and first and second weather-strips engaging the second and third elongated channels and extending sufficiently to form a weather seal with respect to adjacent upper or lower sash assemblies, respectively; and a cover retained by the second and third elongated channels along remainder portions of the second and third channels not retaining a weather-strip.

11. The jambliner assembly of claim 10 wherein at least one of the cover strips further includes a recess engaging portion and a facade portion, the facade portion extending between adjacent weather-strip and either one of the first or fourth elongated channels.

12. The jambliner assembly of claim 10 wherein at least one of the weather-strips includes a weather sealing portion and a pair of resilient legs extending into either one of the second or third elongated channels.

13. The jambliner assembly of claim 12 and further including a spring element within either one of the second or third elongated channels positioned between the resilient legs of the weather-strip and extending to a backwall of either one of the second or third elongated channels.

14. The jamb assembly of claim 13 wherein the spring element is a resilient foam disposed between the resilient legs of the weather-strip.

15. The jamb assembly of claim 10 wherein at least one of the weather-strips includes a weather sealing portion and a spring arm attached at a proximal end to a backside of the weather-strip and the spring arm having a distal free end to engage either the second or third channel to provide a spring force to the weather sealing portion.

16. The jambliner assembly of claim 10 and further including a spring element disposed within either one of the second or third elongated channels, the spring element being positioned on a rearward side of the weather-strip and extending to a backwall of either the second or third elongated channels.

17. The jamb assembly of claim 16 wherein the spring element is a resilient foam that is disposed on a rearward side of the weather-strip and extending to the backwall of the weather-strip retaining recess.

18. The jamb assembly of claim 10 wherein at least one cover strip is made of wood, aluminum or polyvinychloride.

* * * * *